United States Patent [19]

Reed

[11] Patent Number: 4,585,976

[45] Date of Patent: Apr. 29, 1986

[54] BEAM PENETRATION CRT WITH INTERNAL AUTOMATIC CONSTANT DEFLECTION FACTOR AND PATTERN CORRECTION

[75] Inventor: Ronald G. Reed, Colorado Springs, Colo.

[73] Assignee: Hewlett-Packard Company, Palo Alto, Calif.

[21] Appl. No.: 763,873

[22] Filed: Aug. 7, 1985

Related U.S. Application Data

[63] Continuation of Ser. No. 689,494, Jan. 7, 1985, abandoned, which is a continuation of Ser. No. 340,683, Jan. 19, 1982, abandoned.

[51] Int. Cl.[4] ..... H01J 29/46; H01J 29/56

[52] U.S. Cl. ..... 315/370; 315/364; 313/447; 313/448

[58] Field of Search ..... 315/24, 52, 364, 370, 315/375, 376, 382; 313/447, 448, 449, 458, 426, 437, 456; 358/72, 73

[56] References Cited

U.S. PATENT DOCUMENTS

| | | | |
|---|---|---|---|
| 2,523,099 | 9/1950 | De Gier | 313/449 |
| 2,681,426 | 6/1954 | Schlesinger | 315/24 |
| 2,803,781 | 8/1957 | Jurgens | 315/52 |
| 3,772,553 | 11/1973 | Balint et al. | 313/458 X |
| 3,840,773 | 10/1974 | Hart | 315/375 |
| 3,921,025 | 11/1975 | Odenthal | 315/398 X |
| 3,983,444 | 9/1976 | Odenthal | 313/437 X |
| 4,117,379 | 9/1978 | Bijma | 315/370 |
| 4,142,133 | 2/1979 | Balandin et al. | 315/382 |
| 4,196,371 | 4/1980 | McGrath, Jr. | 313/456 |
| 4,338,548 | 7/1982 | Bono et al. | 315/382 |
| 4,352,043 | 9/1982 | Rigden | 313/448 X |
| 4,371,808 | 2/1983 | Urano et al. | 313/426 X |
| 4,450,387 | 5/1984 | Reed et al. | 315/375 |

FOREIGN PATENT DOCUMENTS

| | | | |
|---|---|---|---|
| 1550161 | 12/1968 | France . | |
| 2091547 | 1/1972 | France . | |
| 953881 | 4/1964 | United Kingdom | 313/348 |
| 1162149 | 8/1969 | United Kingdom . | |
| 1467812 | 3/1977 | United Kingdom . | |
| 395928 | 7/1974 | U.S.S.R. | 313/349 |

*Primary Examiner*—Charles T. Jordan
*Assistant Examiner*—Brian S. Steinberger
*Attorney, Agent, or Firm*—Edward L. Miller

[57] ABSTRACT

The horizontal and vertical deflection factors for a split anode beam penetration color CRT are compensated for changes and remain constant as trace color is varied. In an electro-statically deflected tube a correction lens near an expansion mesh and electrically connected to the split anode faceplate alters the radial velocities of electrons leaving the mesh such that their point of impact upon the faceplate is unaffected by changes in axial velocity induced to change trace color. In a magnetically deflected tube a correction lens in the neck near entrance to the deflection yoke is supplied with a voltage that varies in conjunction with that of the faceplate. The axial velocity of the electrons in the region of magnetic deflection is adjusted to produce amounts of deflection that remain constant despite changes in the faceplate voltage.

6 Claims, 12 Drawing Figures

FIGURE 4B
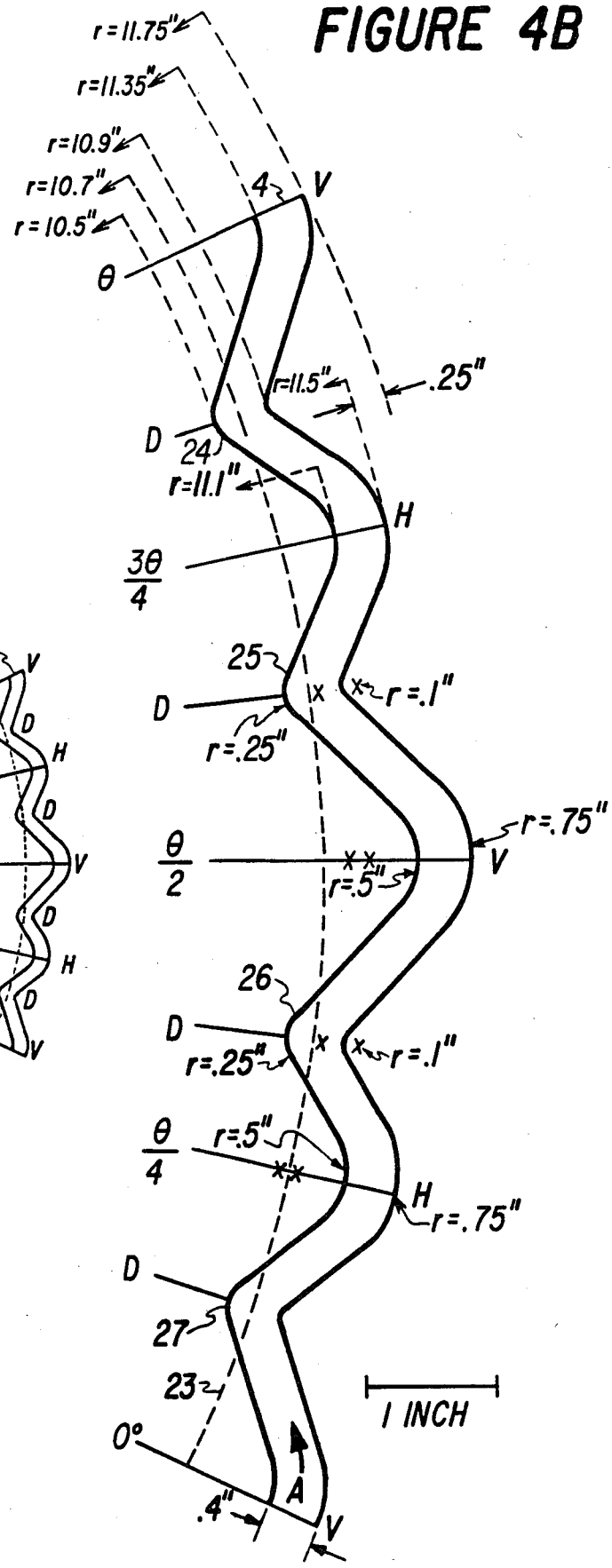
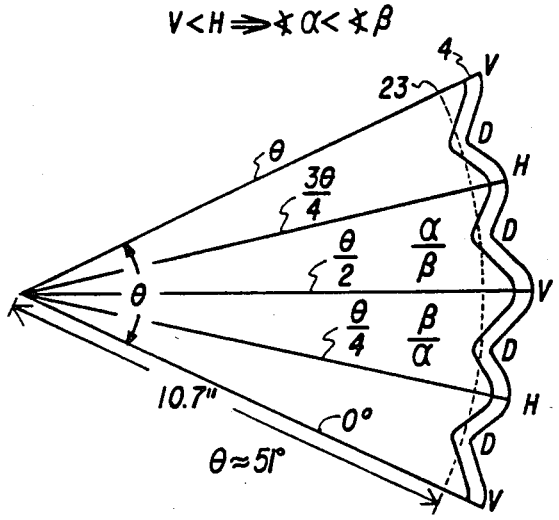
FIGURE 4A

BEAM PENETRATION CRT WITH INTERNAL AUTOMATIC CONSTANT DEFLECTION FACTOR AND PATTERN CORRECTION

This is a continuation of U.S. patent application Ser. No. 689,494 filed Jan. 7, 1985 and now abandoned, which in turn was a continuation of U.S. patent application Ser. No. 340,683 filed Jan. 19, 1982 and also abandoned.

In a beam penetration color cathode ray tube (CRT) the color of the trace is controlled by varying the velocity at which the electrons in the electron beam strike the phosphors on the faceplate. The required variation in velocity is produced by changing the acceleration potential that the electron beam is subjected to. In some CRT's this is achieved by varying a single voltage applied to both the funnel and faceplate. In a so-called "split anode" CRT it is achieved by varying a separate voltage applied to only the faceplate, while a fixed voltage is constantly applied to the funnel. In either case, presently available phosphors require a change of several thousand volts.

A long-standing problem with beam penetration color CRT's is that their deflection factors change by as much as forty percent as the trace color is changed. As the color is changed the resulting different electron velocities along the longitudinal (Z) axis of the CRT afford different amounts of time for radial velocities induced by the deflection mechanism to influence the location of the point of impact upon the faceplate; the slower the longitudinal velocity the greater the radial displacement, and the lower the deflection factor (v/cm). If left unaccounted for, these changes cause images written in one color to differ in size from those written in another. Ideally, images would be the same size regardless of the color they were written in.

The prior solution to the problem of a color-dependent deflection factor has been to vary the gain of the deflection amplifiers as the color is changed. This adds a great deal of complexity both to the deflection amplifier circuitry and to the overall task of controlling a beam penetration color CRT, as the necessary gain changes are functions of the applied high voltage, of which there may be several values, and the gain must track the voltage exactly. It would be desirable if this change in deflection factor could be eliminated within the CRT itself, allowing the deflection amplifiers to operate at fixed gains, regardless of the particular high voltage applied to the tube.

Any compensation for the horizontal and vertical deflection factors must also produce appropriate composite amounts of compensation along diagonal directions, such as the major diagonals from the center of the faceplate to the corners thereof. Improper diagonal compensation will produce either barrel or pin cushion distortion of the displayed pattern. In tubes having an expansion mesh the degree of horizontal and vertical expansion can be controlled by variations in the strength of the electric field surrounding the mesh. Such variations in expansion can produce the required deflection factor compensation. However, an expansion mesh does not simply affect only the horizontal and vertical radial velocities in isolation; *each* radial direction is expanded. Therefore, a proper amount of expansion variation must be selected and produced for each radial direction to ensure distortion free deflection factor compensation.

Therefore, a principal object of the invention is to provide a beam penetration color CRT whose horizontal and vertical deflection factors remain constant as the trace color is changed.

Another object of the invention is to provide a beam penetration color CRT whose horizontal and vertical deflection factors automatically and continuously adjust themselves to remain constant despite arbitrary changes in the applied high voltage that are within the range corresponding to maximum color change.

A further object of the invention is to provide for an electrostatically deflected beam penetration color CRT with an expansion mesh a constant deflection factor that is also free of color induced barrel or pin cushion distortion.

According to a preferred embodiment of the invention these and other objects are achieved in an electrostatically deflected split anode beam penetration color CRT by the inclusion therein of a correction lens centered about the axis of the tube and located in the vicinity of an expansion mesh. In a preferred embodiment to be disclosed the correction lens is a conductive region on the inside of conical portions at the entrance to the funnel region of the CRT envelope. The correction lens is electrically connected to the split anode faceplate, and both receive the same switched high voltage. The shape of the correction lens is chosen to interact with the effect of the expansion mesh to produce compensatory changes in the horizontal, vertical and diagonal radial velocities (i.e., change the amount of expansion in those directions). The changes to those radial velocities prevent the changes in deflection factors produced by the changes in axial acceleration, and do so correctly for *all* applied faceplate voltages, not simply for selected voltages. Thus, the overall vertical and horizontal deflection factors appear unchanged, and automatically remain constant despite changes in color. A selected amount of correction is performed for all radial directions, including the diagonals, and no distortion is induced in the displayed image.

In an alternate embodiment a magnetically deflected split anode beam penetration CRT has its horizontal and vertical deflection factors compensated by a correction lens centered about the axis of the tube and located on the inside of the neck of the CRT near the entrance end of the deflection yoke. The voltage on the correction lens is changed in conjunction with the high voltage for the faceplate. The axial velocity of the electron beam in the magnetic deflection region is varied to compensate for changes in the axial velocity in the region of the faceplate. This varies the amount of deflection in the magnetic deflection region to produce constant overall deflection factors.

BRIEF DESCRIPTION OF THE DRAWINGS

FIGS. 4A and 4B are each a two dimensional rendition of the shape of the gap between the correction lens element and the funnel coating in the CRT of FIG. 1.

DESCRIPTION OF THE PREFERRED EMBODIMENT

Figure 1:
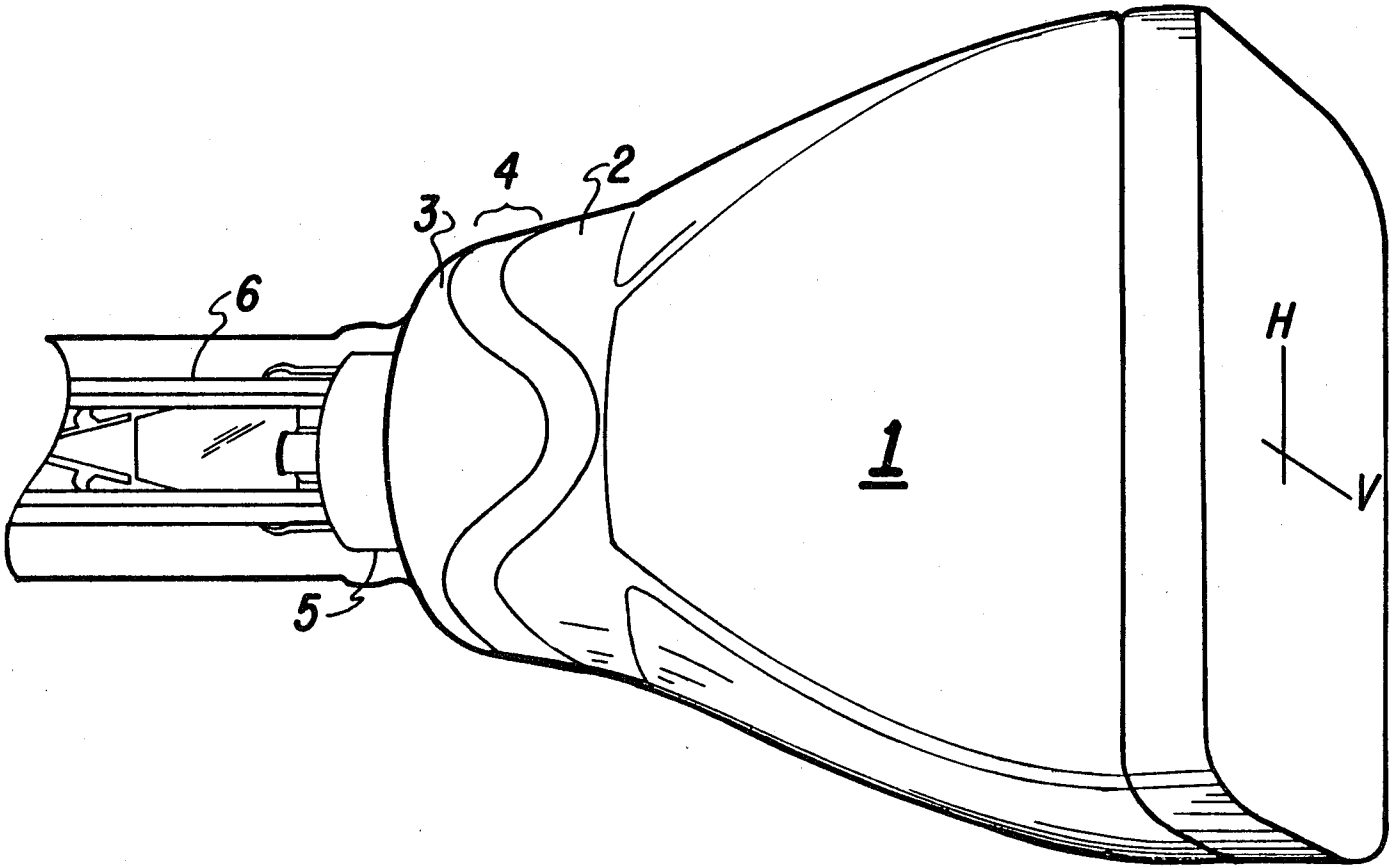
FIG. 1 is a perspective view of an electrostatically deflected beam penetration color CRT having an expansion mesh wherein the amounts of radial expansion are controlled by a correction lens element located in the vicinity of the expansion mesh and wherein the horizontal and vertical deflection factors remain constant and the displayed pattern is free of distortion, despite changes in trace color.

An electrostatically deflected beam penetration color CRT 1 constructed in accordance with a preferred embodiment of the invention is depicted in FIG. 1. At the exit end of an electron gun assembly 6 is situated an expansion mesh (not itself visible) supported upon a "mesh can" 5. Upon the inside of the CRT's envelope, near the expansion mesh and at the entrance of the "funnel", is deposited a four-lobed slightly conical conductive correction lens element 3. The correction lens 3 is electrically connected to the "split anode" facepate by an external conductor (not shown). A dielectric coated gap 4 of essentially constant width separates the conductive correction lens 3 from the conductive coating 2 inside the remaining portion of the CRT funnel. The funnel coating 2 is conventional, except that it complements the shape of the correction lens 3 through the dielectric coated gap 4. The funnel coating 2 is electrically isolated from the faceplate of the CRT 1.

The CRT 1 is intended for use in a small high quality color graphic display device. It has a viewing area approximately five inches wide ("horizontal") by four inches high ("vertical") and is approximately fifteen inches in length. To promote clarity in depicting the various shapes, the CRT 1 has been illustrated as rotated one quarter turn about its longitudinal axis, so that the spatial relation between the horizontal and vertical axes appears interchanged. In this way the broader side of the tube is depicted, allowing a less cramped rendition of the illustrated features.

The particular CRT of FIG. 1 is not intended for use in oscillographic applications requiring a maximum vertical deflection sensitivity, but rather in a graphics application best served by nearly equal horizontal and vertical deflection sensitivities. In this particular tube, therefore, horizontal deflection is performed first (furthest from the faceplate) followed by vertical deflection. It will be apparent to those skilled in the art that the invention is equally applicable to CRT's designed for use where one axis of deflection is to be considerably more sensitive than the other.

Figure 2:
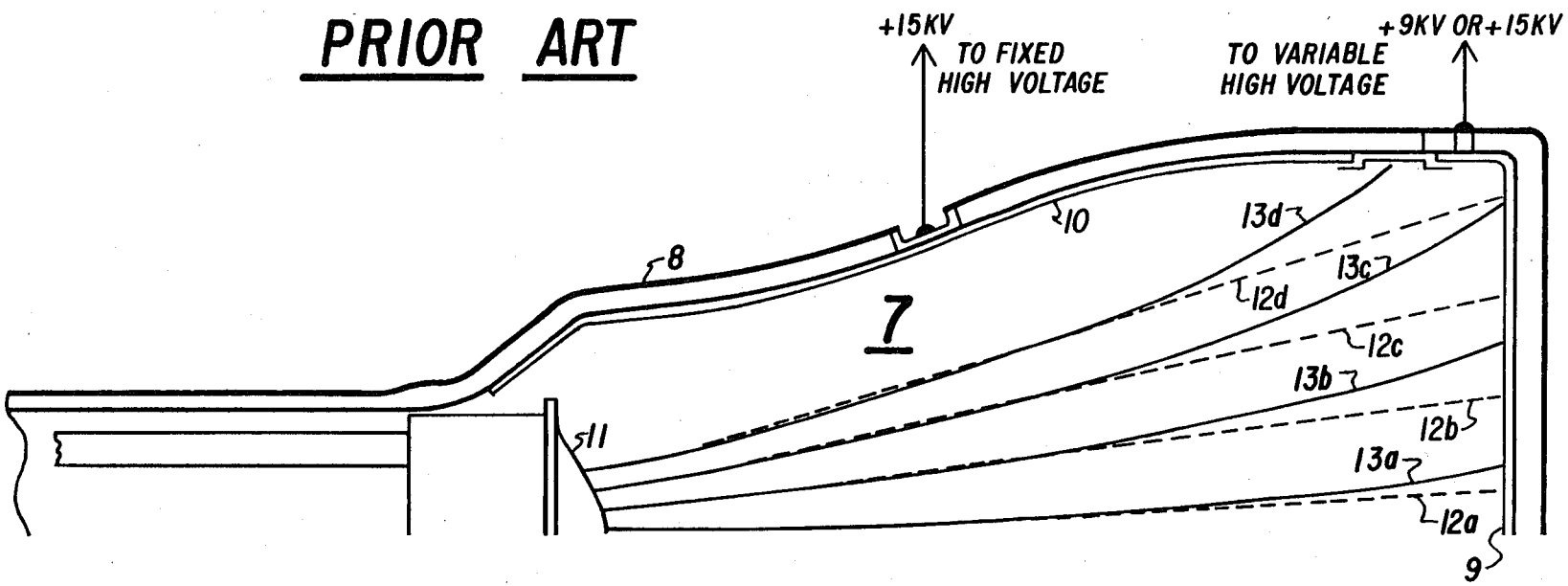
FIG. 2 is a cut-away view of a prior art beam penetration color CRT, with ray traces, illustrating the nature of the problem that produces the color dependent change in deflection factor.

In contrast to the CRT 1 of FIG. 1, FIG. 2 depicts a portion of a conventional split anode beam penetration color CRT 7. In such a CRT 7 the interior of the funnel portion of the envelope 8 is coated with a conductive coating 10 extending from ahead of the expansion mesh 11 to fairly near the faceplate. A separate conductive region 9 is deposited over the phosphors upon the faceplate. The conductive funnel coating 10 is connected to a source of fixed high voltage, while the conductive faceplate coating 9 is connected to a source of variable high voltage.

The fundamental reason for the color dependent deflection factor possessed by this conventional split anode beam penetration CRT is readily understood from an inspection of FIG. 2. Dotted lines 12*a–d* represent ray traces for various amounts of deflection a-d, each with the faceplate operating at plus fifteen kilovolts (for a green trace). The ray traces 12*a–d* form an undistorted pattern produced at some deflection factor. In marked contrast are the solid line ray traces 13*a–d*, produced under conditions differing only in that the faceplate voltage has been lowered to plus nine kilovolts (for a red trace).

The ray traces 12*a–d* and 13*a–d* are essentially the same for the first two thirds of their travel after leaving the expansion mesh. Each is accelerated by substantially the same amount by the conductive coating 10, and the radial velocities, once induced by the deflection plates and expansion mesh, remain unchanged during that portion of travel. For ray traces 12*a–d* the velocity of the electrons in the direction parallel to the longitudinal axis remains, once accelerated by conductive coating 10, essentially constant until the electrons strike the faceplate. Their radial velocities remain constant after leaving the region of the expansion mesh. The ray traces 12*a–d* are thus essentially straight lines. But when the faceplate voltage is lowered the axial velocity progressively decreases as the electrons approach the faceplate, while the radial velocity remains nearly what it was (it actually increases slightly). As the electrons decelerate axially they have ever more time to move radially before impact. The final portions of ray traces 13*a–d* therefore exhibit increasing curvature upon approach to the faceplate. The result is a substantial decrease in the deflection factor (i.e., increased deflection sensitivity) that produces a larger image, although that image is essentially free of pincushion or barrel distortion.

Figure 3:
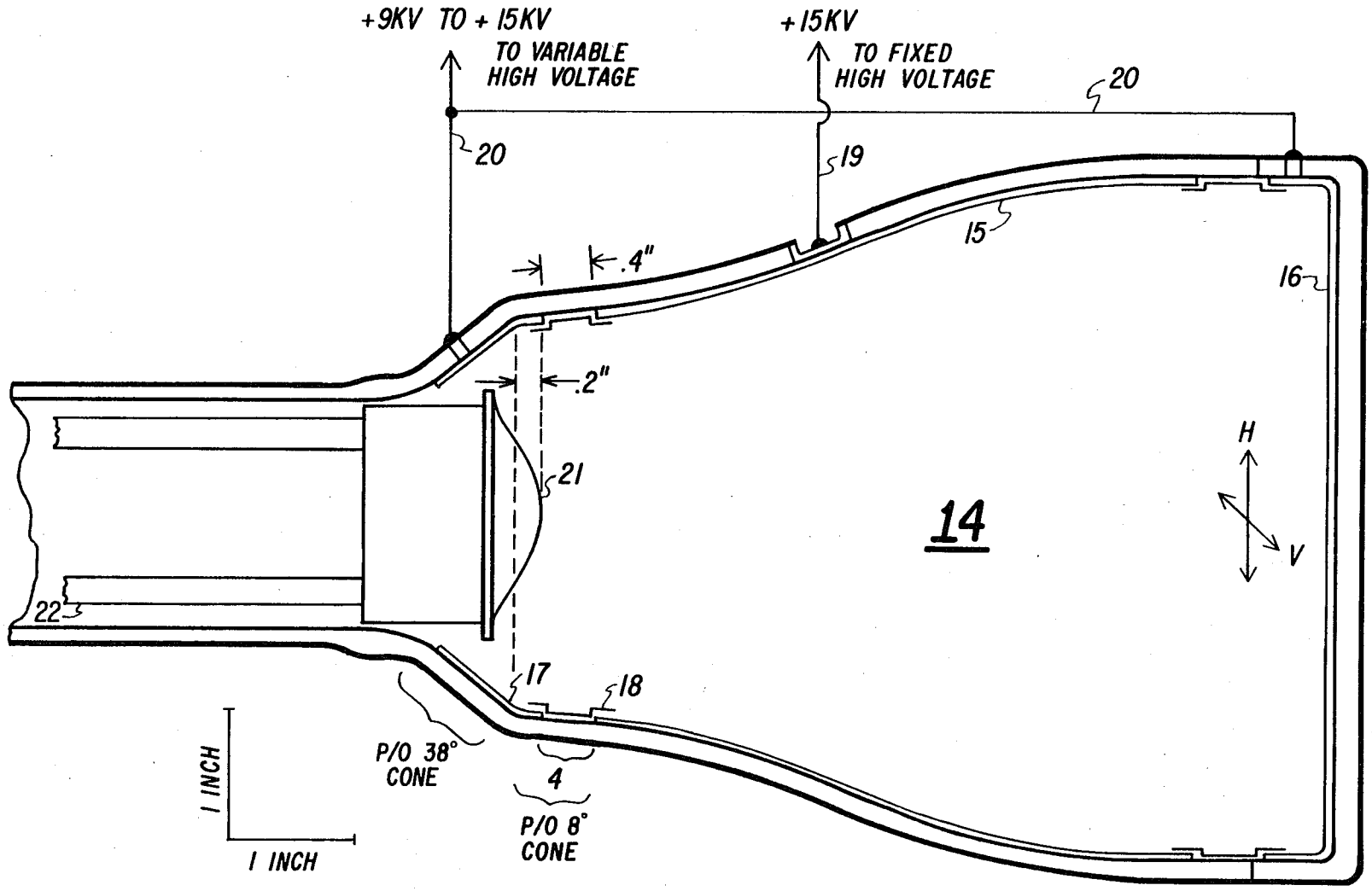
FIG. 3 is a cut-away view of the CRT of FIG. 1.

FIG. 3 is a top cut-away view of a CRT 14 similar to that of FIG. 2, but constructed in accordance with FIG. 1. Deposited upon the inside of the envelope are conductive coatings 17 (corresponding to correction lens 3 of FIG. 1), 15 (corresponding to funnel coating 2) and 16 (the "split anode" at the faceplate). Any conventional means may be used to make electrical contact with the correction lens coating 17, including resilient fingers, "pop throughs" and metal "anode buttons". A layer 18 of insulating "green dag" is applied over the gap 4 separating conductive coatings 17 and 15. A similar insulting layer is applied over the separation between the funnel coating 15 and the faceplate coating 16. In the present example the width of the gap 4 is approximately four tenths of an inch. A conductor 19 connects the funnel coating 15 to a fixed high voltage power supply, which in the present example is plus fifteen kilovolts. Another conductor 20 connects both the faceplate coating 16 and the correction lens coating 17 to a source of variable high voltage, which in the present example can range from plus nine to plus fifteen kilovolts, including various values inbetween. Also shown is an expansion mesh 21 located at the exit end of an electron gun assembly 22.

The interior portion of the envelope upon which the correction lens 17 is deposited is made up of two conical surfaces. The left-hand portion of the funnel in the vicinity of the gap 4 forms a portion of an eight degree cone, while the adjoining portion just to the left (the so-called "reducer") forms a portion of a thirty-eight degree cone. A convenient point of reference in this figure, for things to be depicted in subsequent figures, is the circle (in three dimensions) formed by the intersection of the two conical surfaces. According to FIG. 3, the tip of the expansion mesh 21 extends beyond the plane of that circular line of intersection, and along the longitudinal axis of the tube, by approximately two tenths of an inch.

The shape of the narrowest opening in thirty-eight degree portion of the correction coating 17 is of little concern, if any, since it is so far removed from the electrons emanating from the expansion mesh 21. That shape may conveniently be circular. The shape of the intersection of the two conical surfaces has already been described as circular. The shape of the remaining right-hand edge (as viewed in FIG. 3) of the eight degree conical surface of the correction lens 17, and the corresponding shape of the left-hand edge of the conductive funnel coating 15, are not so easily described. As mentioned earlier, and as can be seen in FIG. 1, a four-lobed shape is involved. This four-lobed shape will be described in terms of the shape of the gap 4 between the correction lens 17 and funnel coating 15. This is because the three dimensional shape of the gap 4 is much more readily depicted than the shape of either of the things it separates. It is clear, however, that each of the remaining shapes can be clearly and unambiguously understood and appreciated from an understanding of the shape of the gap 4.

Figure 5:
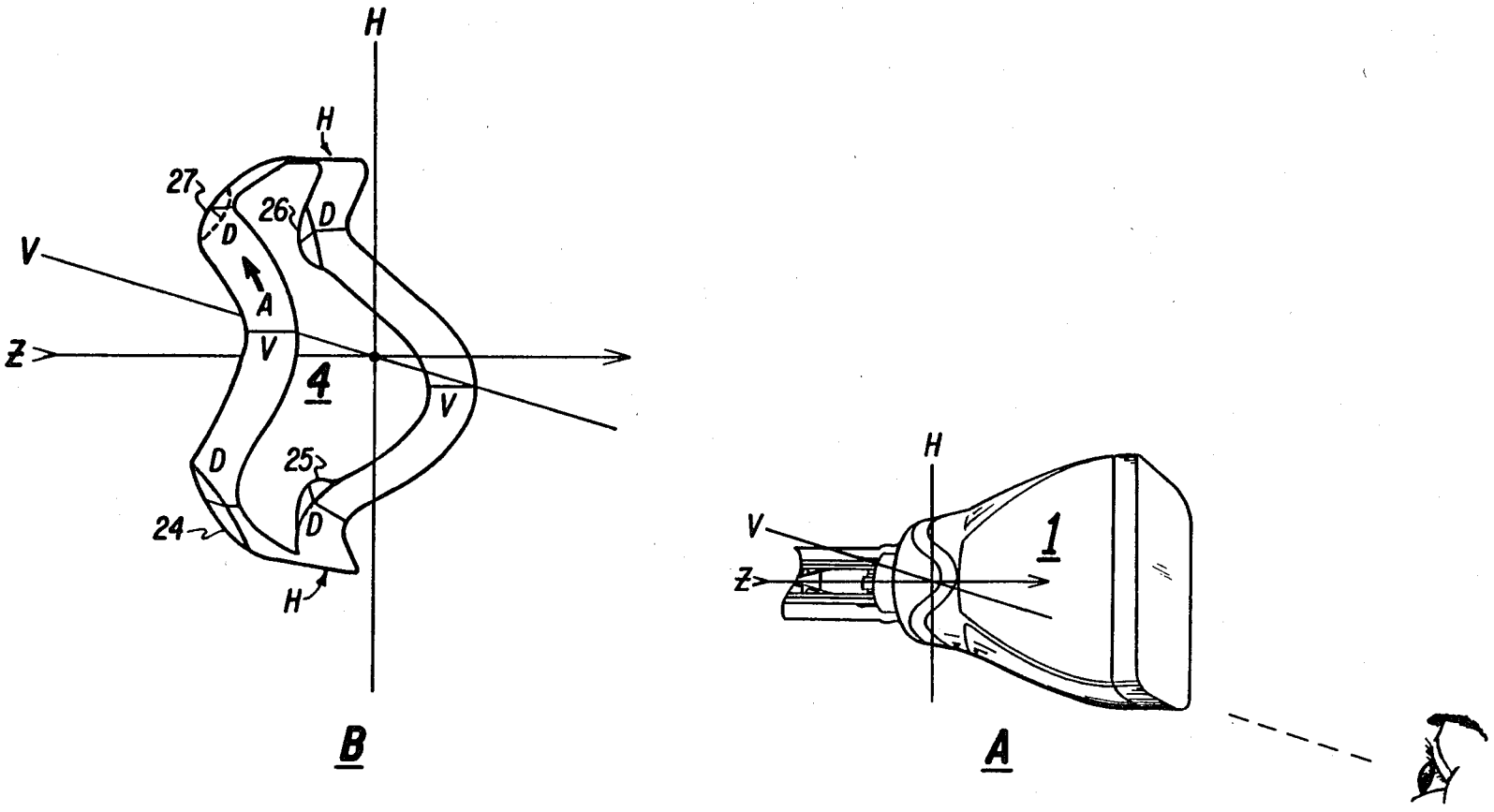
FIGS. 5A and 5B are perspective views of the three dimensional shape and location of the shape shown in FIGS. 4A and 4B.

A final note is in order before proceeding with a discussion of the nature of the shape of the gap 4 and of why that shape performs the desired correction. It will soon become apparent that the gap 4 is not confined to only the eight degree conical surface, but also extends at four places onto a portion of the thirty-eight degree conical surface. Referring briefly to FIG. 5B, the gap 4, if thought of as a surface in its own right, has four "bent tabs" 24–27. As far as is known, these bent regions of the gap have no specially desirable properties owing to their being bent. What happened is that the in and out excursion of the four lobes needed to be certain lengths, and be particularly positioned relative to the expansion mesh, to correctly produce the desired result. The intersection of the reducer and the funnel just happened to lie within the range of those excursions, so portions of the lobes ended up bent. The present tube is a modification of an existing CRT, and a redesign of the location of the expansion mesh or of the shape of the bottle to eliminate those bends was outside the scope of the project. With a different tube the "bent tabs" in the shape of the gap might well be absent, or, more pronounced. In the present tube the bends were simply ignored, with no apparent ill effects.

FIGS. 4A and 4B show, for the particular CRT of FIGS. 1 and 3, the exact shape of the gap 4. What is shown is a planar shape, that if constructed upon a suitable medium, such as a sheet of paper or mylar, then cut out, joined at its ends and bent along the dotted lines, forms the actual three dimensional shape of the gap 4. That is, FIGS. 4A and 4B are essentially a recipe for creating a shape, most of which lies on the surface of an eight degree cone.

In performing the construction, dotted line 23 is a circle of radius 10.7", and corresponds to the circular line of intersection between the two cones. The angle $\theta$ is approximately fifty-one degrees, and was chosen to produce an eight degree cone. To construct the shape of FIG. 4B proceeds as follows. Construct adjacent segments of concentric large circles of the following radii: 10.5"; 10.7"; 10.9"; 11.35"; 11.75". Each segment must subtend the same 51° central angle. Divide the central angle into four equal portions corresponding to the horizontal and vertical axes. Subdivide each of the four equal portions to correspond to the location of its major diagonal (determined by the aspect ratio). In FIG. 4A the angle $\alpha$ is less than $\beta$ owing to the differing symetries about the different major diagonals. For a tube with a square faceplate $\alpha$ would equal $\beta$. Extend from the center to the outermost segment the nine radial lines defining the eight portions. Locate along these radial lines the indicated centers of the various small circle segments of the specified radii, and draw the small circles. Each of these small circles is tangent with an associated large circle, at a point along the associated radial line. Draw the tangent lines connecting the successive small circles along the inner and outer edges of the shape. Mark the shape H, V and D as shown. Cut out the resulting shape and join the corresponding edges along the first and ninth radial. Bend inwards those portions of the shape of radius 0.25" that lie within the circle of radius 10.7".

Absent any distortion, the resulting closed strip forms a four lobed conical surface of the sort shown in FIG. 5B. Referring to the legends H, V and D, FIGS. 5A and 5B show the orientation of the gap 4 in the CRT of FIGS. 1 and 3. This is important, since it will be observed that the lobes marked V are one quarter of an inch longer than those marked H.

It will be understood that the particulars of the foregoing discussion of FIGS. 4A and 4B pertain to a CRT envelope of a certain size and shape and having a particular expansion mesh. Those skilled in the art, however, will be able to draw upon this example to perform corresponding operations for different tubes with different expansion meshes, once the shape of the correction lens is known. Further below, a method is briefly discussed for selecting the shape of a correction lens for any particular tube.

Before passing to a discussion of why this general shape works, a fabrication technique for such a correction lens will be briefly discussed. Both the conductive correction lens and the conductive funnel coating are formed by vapor deposition of aluminum. A masking fixture having the shape of the gap is created from thin stainless steel. It is held in place by gravity against the interior of the reducer. It is thin enough to sufficiently conform to any slight eccentricity in the conical surfaces. The bottle, less faceplate and electron gun, is placed in the aluminization fixture and the conductive coatings (3 and 2, or 17 and 15) are deposited. Afterwards, the coating 18 of insulating green dag may be applied by any convenient means, including hand painting with a brush.

Figure 6:
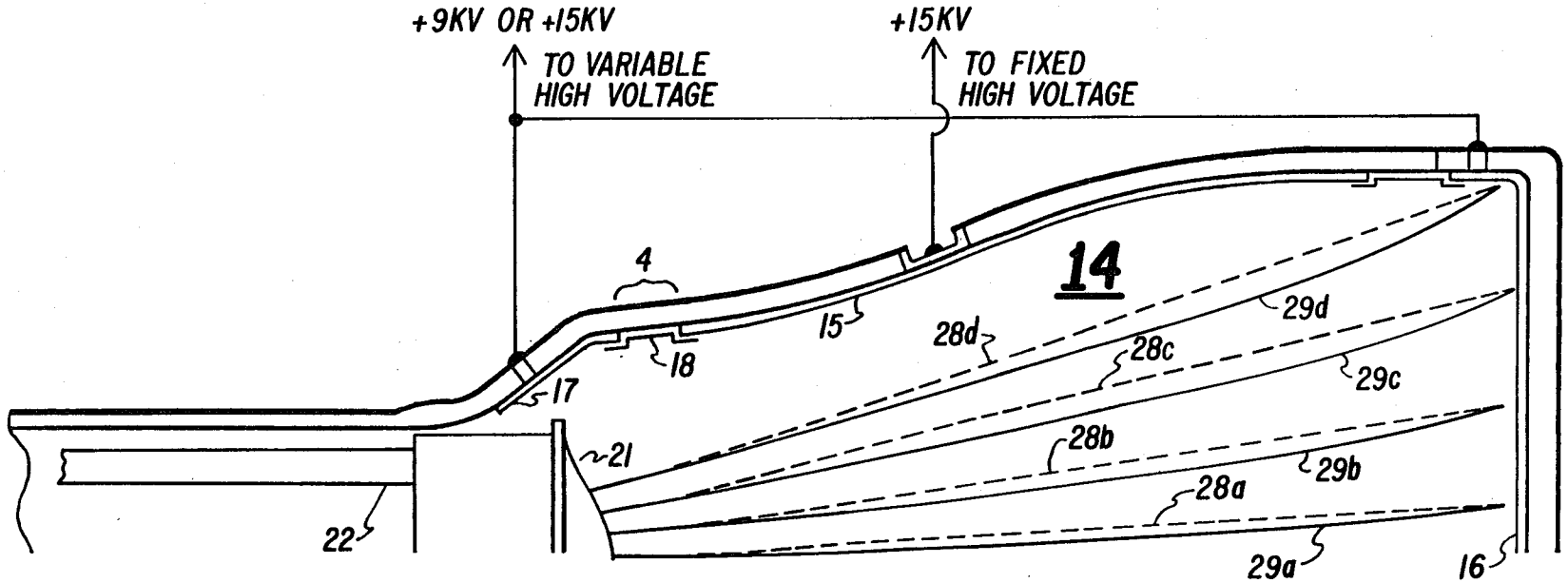
FIG. 6 is a cut-away view of the CRT of FIG. 1, with ray traces illustrating the nature of the compensation applied to correct the color dependent deflection factor error illustrated in FIG. 2.

FIG. 6 illustrates the compensatory influence the correction lens 17 has upon the electron beam as it leaves the expansion mesh 21. As in FIG. 2, dotted lines 28*a–d* represent ray traces for various amounts of deflection while the split anode faceplate 16 is at the same high voltage (+15 kv) as the conductive funnel coating 15. Solid line ray traces 29*a–d* represent the same amounts of deflection when the voltage at the split anode faceplate is lowered to +9 kv. Note that for each of the various amounts of initial deflection a–d the final point of impact upon the faceplate remains unchanged, despite the change in faceplate voltage.

When the faceplate 16 is operated at the same potential as the funnel coating 15, the correction lens 17 exhibits the same potential, also. The net effect is as if the entire tube had one unified interior conductive coating, with neither a separate split anode nor a separate correction lens. The expansion mesh 21 operates as it normally does. That is, there is a high gradient electric field between the region just outside the expansion mesh (at say +100 v) and the adjacent portion of the bottle (+15 kv). This high gradient field produces maximum "magnification" by the expansion mesh 21.

However, when the faceplate 16 is operated at the reduced potential of +9 kv, or at *any* convenient potential between +15 kv and +9 kv, the concomitant reduction of potential at the correction lens 17 reduces the gradient of the electric field surrounding the expansion mesh 21. For each applied faceplate voltage this correctly reduces the amounts of magnification upon the various deflection angles experienced by the electron beam as it emanates from the mesh. The reduction is chosen to be an amount that is restored by the progressive axial deceleration and slight radial acceleration experienced by the electron beam as it approaches the faceplate. The amount of reduction automatically varies correctly as the voltage applied to the faceplate is changed, even if by arbitrary amounts. The illustration of FIG. 6 shows a portion of a top view of the tube, so what is seen is horizontal deflection. The above remarks concerning the operation of the correction lens 17 tacitly assume that there is no accompanying vertical deflection. That is, pattern correction along a diagonal is not considered. Such consideration is, however, necessary to prevent substantial pattern distortion in off-axes directions.

As mentioned earlier, an examination of FIG. 4 reveals that the vertical lobes of the correction lens are longer than their horizontal counterparts. The explanation of why this is so is a convenient point of departure for a subsequent discussion of how pattern correction along the diagonals is obtained.

When the voltage of the correction lens element 2 or 17 is reduced the magnifying power of the expansion mesh 21 is correspondingly reduced. The Snell's Law relationship underlying this is described very briefly below.

Let:

$V_1$ be the potential of the region inside and at the surface of the expansion mesh;

$V_2$ be the potential in the vicinity of the region exterior to the expansion mesh;

$\theta_1$ be the complement of the angle between the path of an electron about to pass through the mesh and a line tangent to the mesh at the point of passage;

$\theta_2$ be the complement of the angle between the path of an electron just past the mesh and a line tangent to the mesh at the point of passage.

Then:

$$\sqrt{V_1}\ \sin\theta_1 = \sqrt{V_2}\ \sin\theta_2 \qquad \text{Eq. (1)}$$

Now, the potential on the surface of the expansion mesh is approximately +100 v. The principle potential outside the expansion mesh is that possessed by the funnel coating 2 or 15. The purpose of the correction lens is first, to act at high voltages like the funnel coating in a conventional split anode beam penetration CRT, and second, to act at low voltages to diminish the effective value of $V_2$ in Eq. (1), by partially shielding the expansion mesh 21 from the influence of the high voltage on the funnel coating with an intervening region at the lower voltage. Assuming a constant distance between a point of interest on the expansion mesh and the nearest point on the funnel coating, the greater the physical separation at the intervening lower voltage, the greater the shielding and the greater the dimunition of the effective value of $V_2$. However, those skilled in understanding the behavior of electric fields will also appreciate that as the point of interest on the mesh moves closer to funnel (i.e., if the "constant distance" of the previous sentence is smaller) the same degree of shielding is obtained with a smaller physical separation at the intervening voltage. Lower values of $V_2$ mean lower amounts of magnification into the region of that value of $V_2$. Clearly, the various values of $V_2$ that are radially distributed around the exterior of the expansion mesh can be varied by changes in the shape of the correction lens element 3 or 17. That is, the degrees of demagnification in the horizontal and vertical axes produced upon leaving the expansion mesh in any given radial location are functions of at least two things: (1) the width of the correction lens in that radial direction; and (2), how far from the center of expansion mesh along that radial direction the beam leaves the mesh. The second condition is important for the same reason as the first: it influences the degree of separation of that portion of the mesh from the high voltage funnel coating 2 or 15, and therefore the effective value of $V_2$. Note that condition (2) (how far from center on the mesh the beam exits) is essentially a function of the extent the deflection plates have influenced the beam *before* it passes through the expansion mesh.

Why the vertical lobes of the correction lens are longer than the horizontal lobes is explained as follows.

Consider horizontal deflection. As mentioned earlier, in this particular tube it is performed first, since the horizontal extent of the faceplate exceeds that of the vertical and it is desired to minimize the difference between the horizontal and vertical deflection factors. This means that under full horizontal deflection (but with no vertical deflection) the beam wil pass through the expansion mesh fairly far from the center (i.e., at a large radial distance).

On the other hand, maximum vertical deflection (with no horizontal deflection) does not pass through the mesh at nearly so great a radial distance, both because the vertical deflection plates are closer to the mesh (less time for vertical radial velocities to produce deflection) and because less deflection is required anyway (vertical dimension of the faceplate less than the horizontal dimension).

Assume that the switching of the faceplate to the lower voltage produces an equal percentage decrease in both the horizontal and vertical deflection factors. (In practice, the vertical decrease tends to be a few percent greater.) Then what is required is an equal decrease in the degrees of horizontal and vertical magnification by the expansion mesh. (Or, perhaps even a slightly greater decrease for the vertical.) But because a maximally deflected vertical ray has a smaller radial distance from the center of the expansion mesh, and in spite of the fact that the associated voltage gradient is not as large as for a maximally deflected horizontal ray, the means for producing the correction must operate a greater distance away from where the beam emerges from the expansion mesh, but must still obtain the same results. (The more so if a slightly greater results are needed.) The necessary correction therefore requires longer vertical lobes on the correction lens element.

Now consider deflection along a major diagonal. This occurs when both maximum vertical and maximum horizontal deflection occur simultaneously. This condition produces the greatest possible radial distance from the center of the expansion mesh to the exit point of the deflected beam as it passes through the mesh. Because of the close proximity of that exit point to the high voltage of the funnel coating only a relatively small width of intervening voltage is needed to produce the necessary change in the effective value of $V_2$. Therefore, the width of the correction lens element is at a minimum at the major diagonals. These minimum values are each equal, since the associated radial distances are the same for each of the major diagonals. And since the four minimum diagonal widths are each in between larger and unequal values of horizontal and vertical widths, the result is the scalloped correction lens shown in FIGS. 1 and 5.

It will be appreciated that variations in the width of the gap 4 between the correction lens element and the funnel coating can also affect the contour of the correction lens itself. These variations may be either changes from one constant overall width to another, or, local variations in width from one location on the gap 4 to another.

Although the correction lens described herein can be shaped so that for any given tube exact correction occurs, that shape depends in part upon the size and shape of the CRT envelope. If little or no attention is paid to tolerances for the envelope, a given shape may not correct exactly each tube wherein it is used, even though those tubes are each of the same type and are each directly replaceable by the other. If adequate tolerances for the size and shape of the envelope are not to be maintained, it may be desirable to equip the deflection amplifier circuitry with an adjustable amount of electrically variable gain, anyway. However, such variability need only amount to a change in gain of a few percent, and would still be easier than providing a forty percent change. The exact amount of the gain variation would be adjusted in a calibration process once the CRT was installed, as its amount would be a function of that particular CRT.

Experience with the present tube suggests that unusual tolerances for the envelope are not required, and that very nearly exact correction can be expected from one tube to another within a given type, with no extra attention paid to envelope tolerances.

Figure 7:
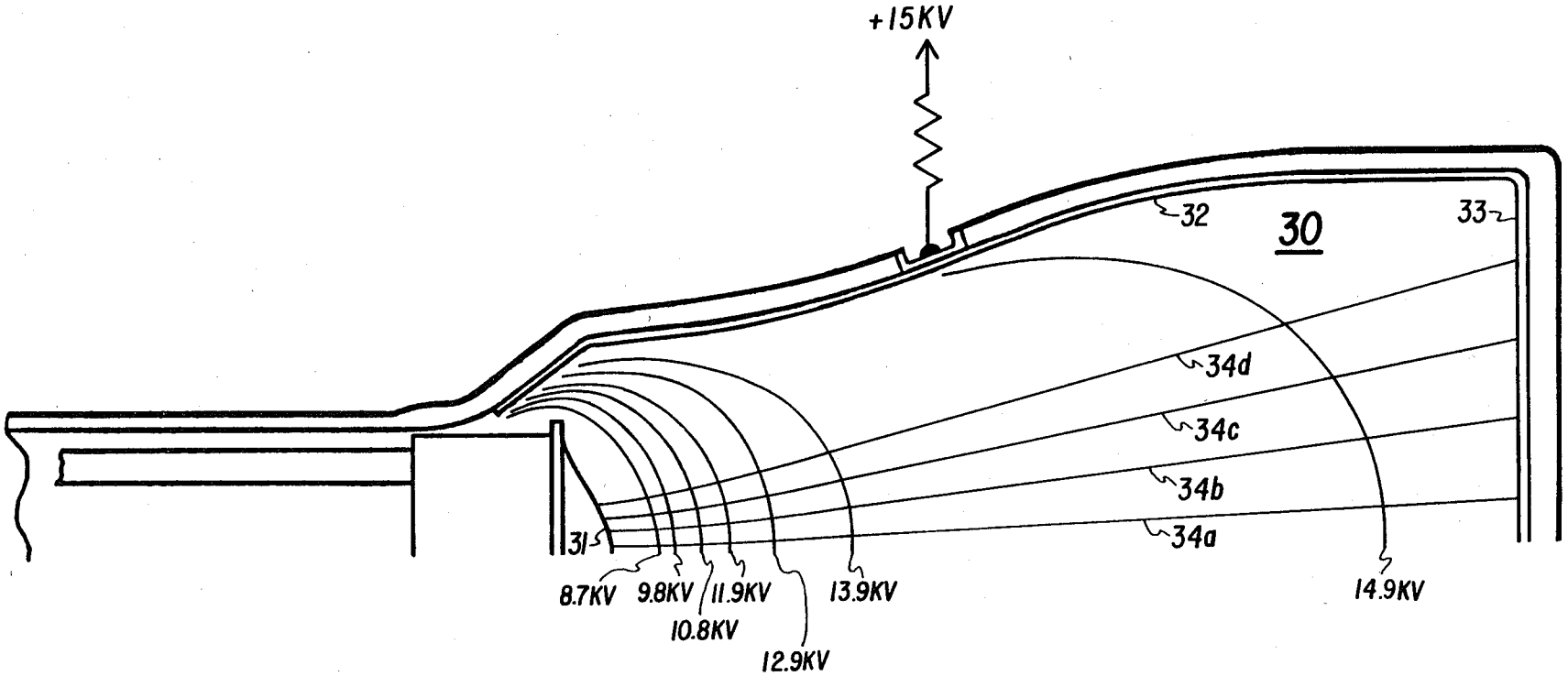
FIG. 7 is a cut-away view of a conventional electrostatically deflected monochrome CRT having an expansion mesh, showing how the isopotential lines in the internal electric field produce the radial expansion afforded by the expansion mesh.
Figure 8:
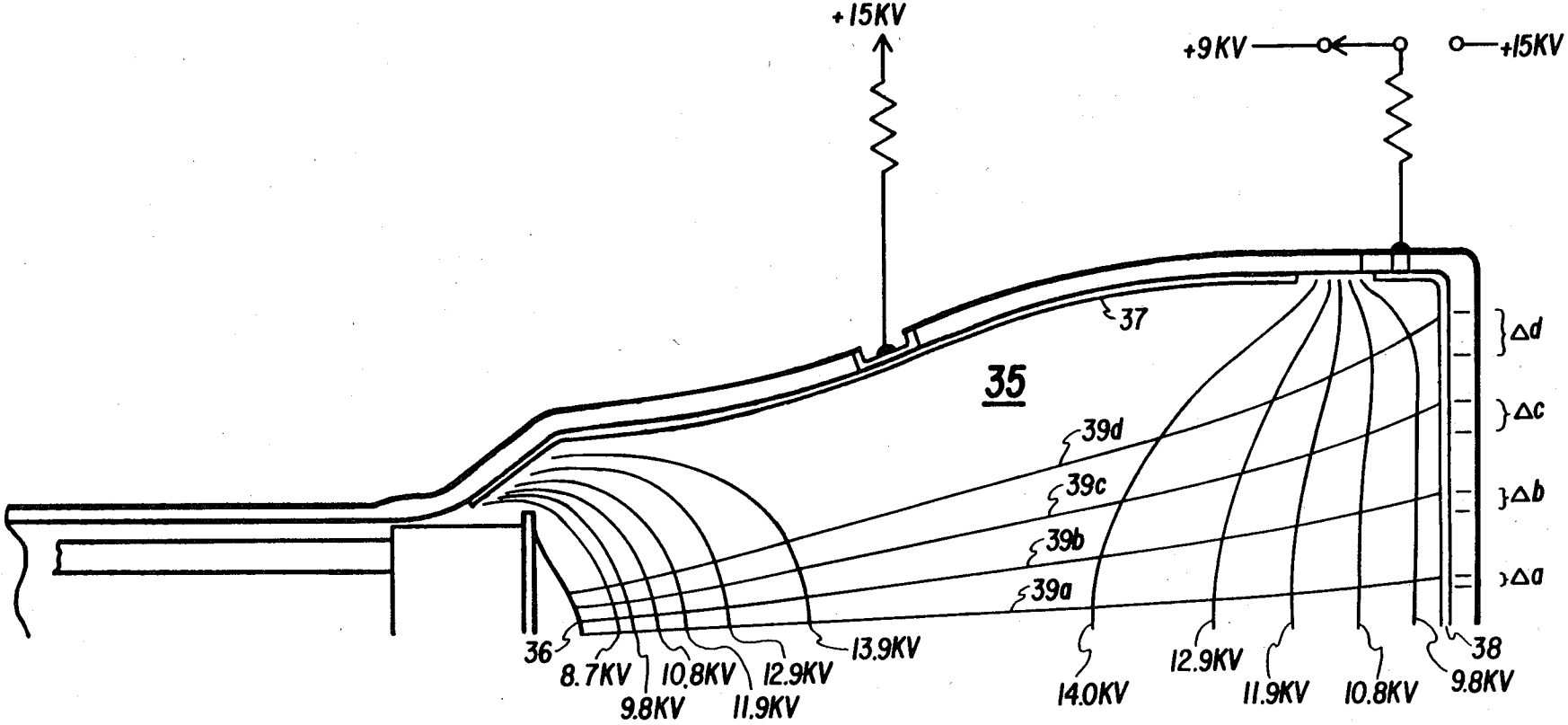
FIG. 8 is a cut-away view of a conventional electrostatically deflected split anode beam penetration color CRT having an expansion mesh, showing how the isopotential lines in the internal electric fields produce the color dependent deflection factor variation.
Figure 9:
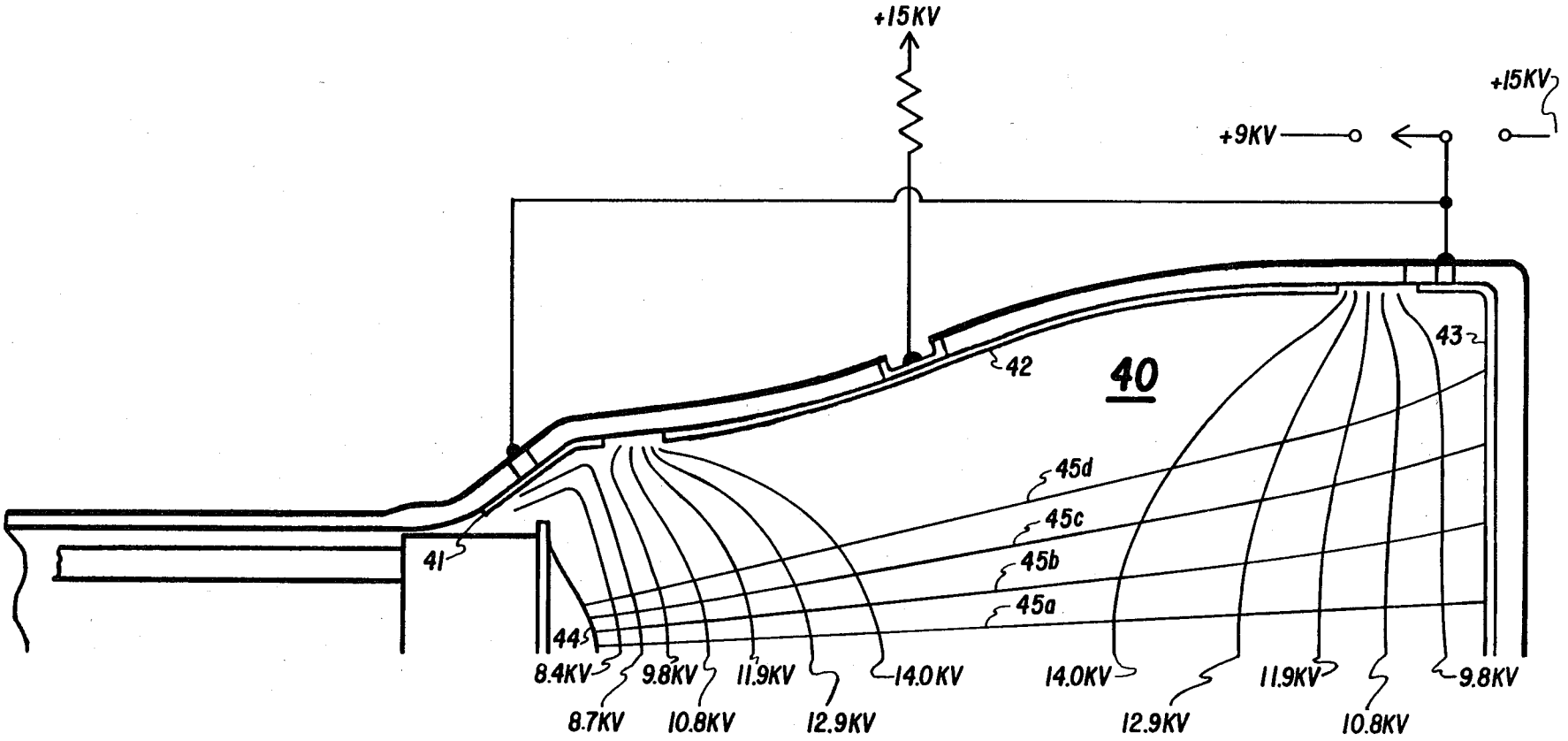
FIG. 9 is a cut-away view of an electrostatically deflected split anode beam penetration color CRT having an expansion mesh, and in accordance with a preferred embodiment of the invention, also having a correction lens in the vicinity of the expansion mesh, and illustrates how the correction lens changes the shape of the electric field around the expansion mesh to compensate for color induced deflection factor variations.

A more detailed explanation of the principles of the operation of the correction lens element is given in FIGS. 7–9.

FIG. 7 shows a cut-away view of a conventional electrostatically deflected CRT 30 having an expansion mesh 31. As before, the expansion mesh 31 is at about +100 v, while the funnel coating 32 and faceplate 33 are each at +15 kv.

Also shown are the various isopotential lines for the electric field between the expansion mesh 31 and the rest of the tube. As can be seen from the figure, the highest field gradients, and the greatest curvatures in the field, are found closest to the expansion mesh 31. The majority of the expansion performed for ray traces 34*a–d* occurs by the time an electron in the ray reaches the 11.9 kv isopotential line. All but a very small amount of expansion is complete by the time the 13.9 kv isopotential line is reached. From that point on the electrons are essentially in a drift space, and their trajectories are almost perfect straight lines.

FIG. 8 shows a cut-away view of a CRT 35 similar to the CRT 30 of FIG. 7, save for the introduction of a split anode faceplate 38 isolated from the funnel coating 37. The expansion mesh 36 of FIG. 8 is the same as the expansion mesh 31 of FIG. 7, and is surrounded by (perhaps not exactly, but virtually) the same electric field. Therefore the same amounts of expansion for given amounts of deflection occurs, up until the end of the drift space, for both the CRT 35 of FIG. 8 and CRT 30 of FIG. 7.

However, the drift space of the CRT 35 of FIG. 8 ends well before the faceplate 38, upon encountering the curved isopotential lines of the electric field in the vicinity of the reduced voltage faceplate 38. It is in this region that the electrons in the various rays 39*a–d* are slightly accelerated radially and greatly decelerated axially. The various legends Δa–Δd indicate the amounts of error in the resulting trace positions.

FIG. 9 shows how an instance of the invention operates to modify and combine aspects of FIGS. 7 and 8. An electrostrically deflected beam penetration color CRT 40 includes a conductive correction lens element 41 electrically connected to a split anode faceplate 43. Between the two, and electrically isolated from each, is a conductive funnel coating 42. The left-hand portion of FIG. 9 shows the isopotential lines of the electric field surrounding the expansion mesh 44. In contrast with the corresponding fields of FIGS. 7 and 8, the field around the expansion mesh 44 of FIG. 9 exhibits a lesser field gradient and a lesser degree of curvature. Comparison of these figures reveals that while the gradient is essentially the same very near the longitudinal axis, a definite reduction in the gradient is seen along the periphery of the expansion mesh 44, together with less of a tendancy of the isopotential lines to follow the curvature of the mesh. The reduction in curvature is produced by the "pulling" of those isopotential lines of less than approximately 9 kv toward the gap between the conductive correction lens element 41 and the funnel coating 42. It is clear that this lessening of the field gradient at increasing radial distances along the mesh, along with the associated reduction in field curvature, results in decreasing amounts of expansion at each successive point on expansion mesh 44, as compared to the same points on the expansion meshes of FIGS. 7 and 8. It is also clear that the location of the gap plays a major role in determining the reduction in the amount of expansion. The previously explained need for different amounts of expansion reduction in different directions of deflection, required with certain classes of CRT's, therefore produces a correction lens element 41 whose shape varies regularly, and with a certain symmetry, according to the direction of deflection.

Therefore, rays 45*a–d* are each expanded by a lesser amount than their counterparts 39*a–d* of FIG. 8. The axial deceleration and slight radial acceleration encountered by rays 45*a–d* as they pass through the isopotential lines surrounding the faceplate 43 counteract the reduced amounts of expansion to produce points of impact that are the same as for rays 34*a–d* of FIG. 7 (assuming a-d represent the same amounts of initial deflection).

The curved isopotential lines of the electric field surrounding the expansion mesh 44 and those in the vicinity of the faceplate 43 can each be considered a lens. The "power" of each lens is determined by the difference in voltage of the elements that form the lens, and by the geometries of those elements. Since the voltages for elements 41 and 43 are equal, vary together, and always greater than the mesh voltage and less than or equal to the funnel voltage, decreasing the voltage difference (between elements 41 and 44) for the "expansion mesh lens" lowers the power of that lens, while that same change in potential (but now between elements 42 and 43) increases the power of the "faceplate lens." The change in the powers of these lenses are complicated functions of the voltage differences. Very roughly speaking, the power is the ability of the field to accelerate or decelerate electrons.

It will be readily appreciated that it is desirable to choose the size and shape of the correction lens element 41/17/3 so that when it provides proper correction at an extreme downward voltage excursion of the faceplate, say down to +9 kv from a high of +15 kv, it automatically operates essentially correctly at intervening voltage values as well. It can be shown that the function describing the decrease in radial acceleration by the mesh lens produced by a drop in correction element voltage is similar in nature to the functions describing the deceleration in axial velocity and increase in radial velocity by the faceplate lens. By adjusting the dimensions of the correction lens element the mesh lens function can be "scaled" to match combined effects of the faceplate lens functions, not just at the extreme lowest voltage, but at intervening values as well. Thereafter, variations in one lens are automatically offset by a complementary variation in the other lens, for any given change in voltage.

Although it is not depicted in FIG. 9, it will be understood that the electric field between the funnel coating 42 and the faceplate 43 has its greatest curvature at the corners of the faceplate. That is, the lines of electric force (not the isopotential lines) emanating from the funnel coating to the faceplate are crowded together as the envelope bends in the region where the surfaces that are the "vertical side" and "horizontal side" meet to form an edge. The faceplate lens therefore has its greatest "power" in the corners. Nevertheless, it appears fairly certain that for the particular tube of the present example this did not contribute significantly to pattern distortion experienced with certain early correction element shapes. For example, when the faceplate voltage for the present CRT is lowered without any correction lens element in operation, a considerable change results in deflection factors, but no pattern distortion in the corners is discernable. It therefore appears that a barrel distortion for those early shapes resulted from overcorrection for diagonal directions of deflection.

For rays directed into the corner regions the mesh lens must achieve a nominal amount of demagnification commensurate with that for the major axes. The four regions marked "D" on FIGS. 4B and 5B are the locations on the correction lens element corresponding to the corners of the faceplate. While on the one hand one is tempted to argue that those locations on the correction lens element 41/17/3 ought to produce a minimum demagnification in the operation of the expansion mesh, owing to their minimum width, two other considerations must also be remembered. First, the extreme location on the expansion mesh from which those diagonal rays emanate place them closest to the field emanating from the funnel coating, so that smaller intervening fields still have a pronounced effect. Second, the points of minimum width marked "D" are not there all by their lonesome selves. They are surrounded on each side by fairly steep-sided lobes. These sides interact with the locations marked "D", so that the field disturbance at the mesh for the diagonals would seem to be the result of a correction element width that "appears wider than it really is." For these two reasons, therefore, the described shape for the correction lens element 41/17/3 does indeed produce a nominal amount of demagnification for maximally deflected diagonal rays, commensurate with that for other directions of deflection.

It will come as no surprise to those skilled in the art of electron optics that analytical models, even those implemented with a computer. do not always provide the most accurate and reliable information. It often happens that those tools can only be used to predict trends, and little else. Such was the case while developing the correction lens element shape for the CRT of the present example, and many empirical trials were required to pin down the necessary size, shape, and location.

Initial investigations with the computer model suggesting the feasibility of on-axis scale correction were confirmed in empirical trials. Some educated estimates and further trials produced a nearly cylindrical correction lens element with two lobes at the extremes of the vertical axis that also satisfactorily compensated for on-axis deflection factor changes at all intervening voltages. However, even though these various early shapes were encouraging, they each induced an unexpected barrel distortion. The task of understanding the cause of the barrel distortion led to the previously stated properties of the expansion mesh concerning the radial distance away from the center of the mesh to the location where the beam emerges. This understanding led to the present four-lobed shape. The effects of the lobes interact considerably, and the whole process of choosing sizes and location had to be repeated with several empirical trials, to select a shape that performs proper deflection factor correction at all voltages while simultaneously performing proper pattern correction.

Development work was stopped after the following results were obtained. At the +9 kv voltage for red, the displayed image is very slightly overcorrected. That is, a red image and an identical green (full +15 kv) image differ in size by an amount that is just barely perceptible (one quarter of a trace line width, or approximately 0.005″). From that extreme the error decreases steadily as faceplate voltage is raised until it vanishes entirely by the time an amber trace is displayed. From amber to green is essentially perfect. No discernable pattern distortion exists at any color.

The shape was arrived at by a combination of empirical testing and computer analysis using finite element modeling techniques. Any of a number of well known computer programs are useful in this connection. One such program is William B. Hermannsfeldt's "Electron Trajectory Program" published in 1973 by the Stanford Linear Accelerator Center, pub. #SLAC-166 (A) UC-28, and which was developed for the AEC under contract #14T (04-3)515. This Fortran program is available from the National Technical Information Service, which is part of the Department of Commerce, and is located in Springfield, Va.

Once the final shape was known, observation suggested a relationship between the shape of the correction lens element and the shape of the faceplate. That observation is repeated here, with the caveat that it is unclear how safe it is to generalize and apply the relationship to CRT's of substantially different design.

It was observed that the shape of the edge of the correction lens element either is or resembles a projection of the rectangular shape of the faceplate onto the conical surface adjoining the funnel portion of the CRT envelope. Imagine a right section of a right eight degree cone of dimensions corresponding to the CRT envelope in the vicinity of the expansion mesh. Select a first point lying along the axis of the conical section, probably one closer to the narrower end of the section than to the wider end. Imagine a rectangle having the proportions of the faceplate, lying in a plane perpendicular to the axis of the conical section, and whose center lies on that axis at a second point probably nearer to the wider end of the conical section than to the narrower end. Imagine a line pivotally connected to the first point and intersecting the edges of the rectangle. Let the line travel along the perimeter of the rectangle. The resulting path of intersection between the line and the surface of the conical section is similar to the shape of the edge of the correction lens element 41/17/3 depicted in FIGS. 1 and 5.

The principles of the present invention have been employed in modifying the behavior of an expansion mesh in another electrostatically deflected CRT having an expansion mesh. That CRT was a monochrome CRT operating at a fixed acceleration potential, and was of a design that did not originally include an expansion mesh. It was desired to put a standard and readily available expansion mesh into the tube to increase its deflection sensitivity. The desired increase was achieved, but at the expense of a perceptible amount of pattern distortion caused by an improper amount of expansion along diagonal directions. The distortion was removed by the use of a correction lens element essentially similar to that which has been described, but operated at a fixed potential.

It will be appreciated that the correction lens element described herein need not necessarily be a conductive coating upon the inside of the CRT envelope, although that will often be the most convenient method. Other means influencing the trajectory of the electron beam could be used, including shapes formed from sheet metal and suitably disposed about the path of the beam. In the example of the previous paragraph, metal tabs were attached to the mesh can by insulating standoffs.

DESCRIPTION OF AN ALTERNATE EMBODIMENT

Figure 10:
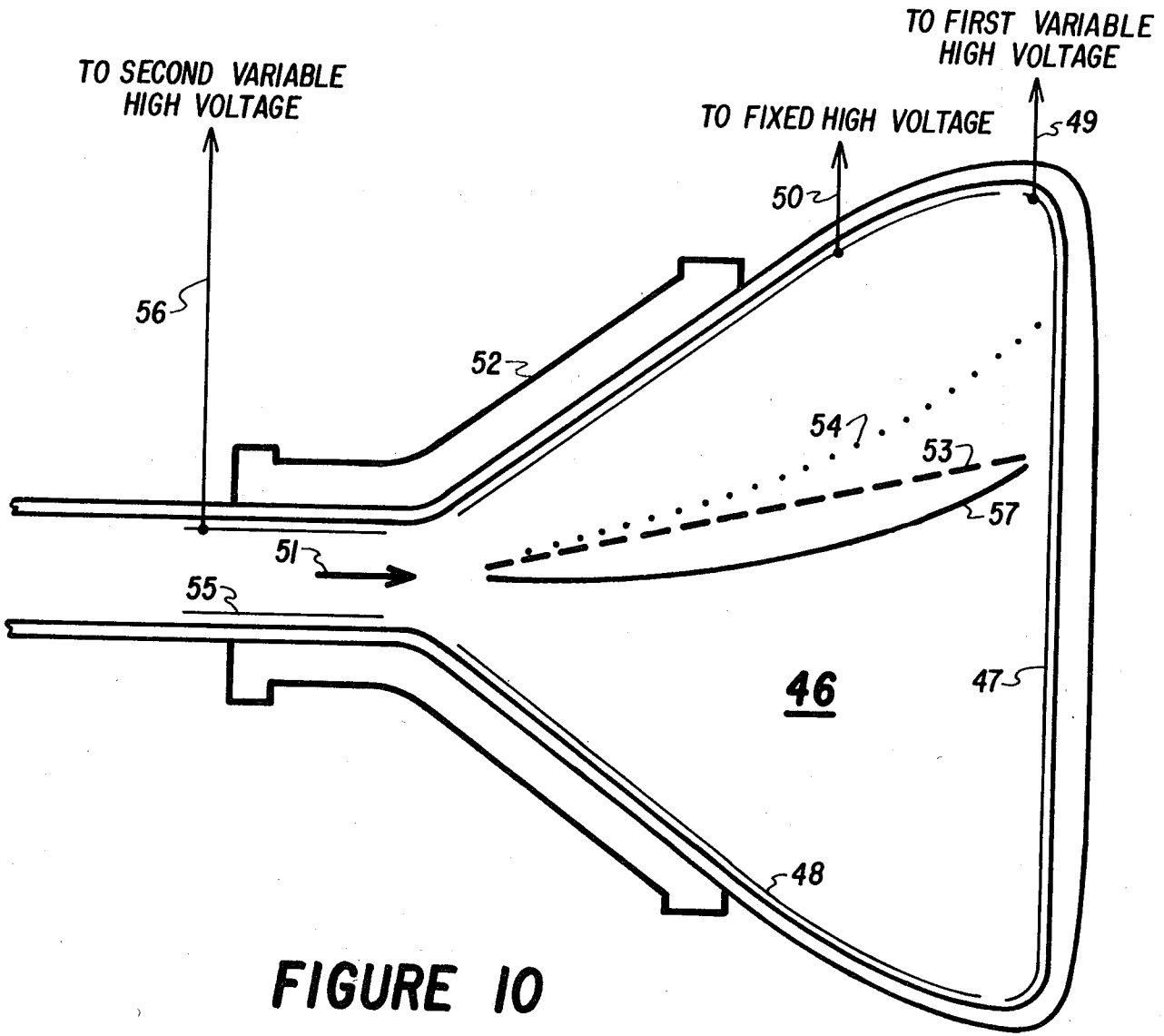
FIG. 10 is a cut-away view of a magnetically deflected CRT without an expansion mesh, and in accordance with an alternate embodiment of the invention, having a correction lens element located at the entrance of the region of magnetic deflection.

FIG. 10 shows a magnetically deflected beam penetration color CRT 46 having a split anode faceplate 47 separated from a funnel coating 48. A conductor 49 connects the split anode faceplate 47 to a first variable high voltage source (not shown), while another conductor 50 connects the funnel coating 48 to a fixed source of high voltage (also not shown). An electron gun assembly (not shown) in the neck of CRT 46 supplies a focused electron beam 51. A magnetic deflection yoke assembly 52 contains both horizontal and vertical deflection coils, to be driven by suitable deflection amplifiers (not shown).

As in the case of an electrostatically deflected CRT, trace color changes are achieved by altering the positive high voltage applied to the split anode faceplate. For the present example it may be assumed that the funnel coating operates at a fixed high voltage of plus twenty kilovolts, and that the split anode faceplate operates over the range of from plus ten kilovolts to plus twenty kilovolts.

Broken line 53 denotes a ray trace for an initial given amount of deflection of the electron beam 51, assuming that the faceplate is raised to its full potential of plus twenty thousand volts. Assuming the absence of any correction lens whatsoever, dotted line 54 denotes the resulting ray trace, for the same given amount of initial deflection as for ray trace 53, when the split anode faceplate 47 is lowered to plus ten thousand volts. As in the case of an electrostatically deflected CRT the deflection process induces a radial velocity into the electron beam. The reduced faceplate voltage reduces the axial velocity of the beam as it nears the faceplate. The resulting increase in transit time allows the radial velocity to produce a greater displacement prior to impact, resulting in greater deflection.

Consider now the effect of a correction lens 55 in the form of an annular conductive surface located inside the neck of the CRT 46, centered on the path of the electron beam 51 and axially positioned prior to where the electron beam 51 enters the region of magnetic deflection produced by the yoke 52. A conductor 56 connects the correction lens 55 to a second variable high voltage source (not shown). As the trace color is changed, the first and second high voltage sources vary simultaneously in the following manner. As the voltage applied to the split anode faceplate 47 decreases, a positive high voltage applied to the correction lens 55 increases. The increase in voltage to the correction lens axially accelerates the electron beam 51 by the amount required to maintain a constant transit time. The result is an unchanged deflection factor, as indicated by the unchanged point of impact for the solid line ray trace 57. Similarly, as the voltage applied to the split anode faceplate 47 increases the positive high voltage applied to the correction lens 55 decreases. If the magnetically deflected CRT is equiped with dynamic focus it may be desirable to also couple the dynamic focus circuit to the circuitry controlling the voltage applied to the correction lens.

It will be understood by those skilled in the art that the alternate embodiment described above could also be applied to an electrostatically deflected CRT not having an expansion mesh.

I claim:

1. A beam penetration CRT comprising:

an evacuated envelope including distal neck and faceplate portions separated by and joined to an intervening funnel portion;

means located within the neck for generating an electron beam traveling along a principal axis toward the faceplate;

means located within the neck and proximate the junction of the neck and funnel for deflecting the electron beam in the directions of first and second deflection axes each perpendicular to the principal axis;

a conductive funnel coating upon the interior surface of the funnel;

a coating of beam penetration phosphors upon the interior surface of the faceplate and electrically isolated from the conductive funnel coating;

an expansion mesh located in the path of the deflected electron beam and proximate the junction of the neck and funnel; and a correction lens about the principal axis, located between the expansion mesh and the conductive funnel coating, the correction lens:

extending uniformly in a direction toward the neck until it is at least adjacent the expansion mesh;

extending in a direction toward plane of the faceplate as four lobes each located ninety degrees apart around the principal axis and each corresponding to a direction along an associated axis of deflection;

extending in a direction toward the plane of the faceplate as four intervening valleys each corresponding to a diagonal direction of deflection; and being electrically isolated from the conductive funnel coating.

2. A beam penetration CRT as in claim 1 wherein two opposing lobes extend closer to the plane of the faceplate than do the remaining two.

3. A beam penetration CRT as in claim 1 wherein the correction lens comprises a coating of a conductive material deposited upon the inside of the envelope.

4. A beam penetration CRT as in claim 3 wherein the conductive funnel coating has, proximate the four lobes and intervening valleys of the correction lens, a corresponding and complementary shape, and wherein there is a gap of uniform width between the correction lens and the conductive funnel coating.

5. A beam penetration CRT as in claim 1 wherein the correction lens is electrically connected to the coating of beam penetration phosphorus.

6. A method for compensating variations of deflection sensitivity in a split anode beam penetration CRT as trace color is changed, comprising the steps of:

directing an electron beam deflected in orthogonal principal axes through an expansion mesh and toward a faceplate;

applying a fixed acceleration voltage to a funnel coating located between the faceplate and the expansion mesh;

operating the CRT at a first trace color and with first and second deflection sensitivities in the respective principal axes of deflection by the steps of:

operating the faceplate at the fixed acceleration voltage;

operating a shielding electrode between the expansion mesh and the funnel coating at the fixed acceleration voltage; and creating from the expansion mesh to the shielding electrode and to the funnel coating an electric field having uniform curvature in each radial direction about the path of an undeflected electron beam; and operating the CRT at a second trace color and with unchanged first and second deflection sensitivities by the steps of:

reducing the voltage applied to the faceplate;

applying the reduced voltage of the faceplate to the shielding electrode; and reducing in each radial direction the curvature of the electric field between the expansion mesh and the funnel coating in accordance with the shape of the shielding electrode and the voltage difference from the expansion mesh to the shielding electrode, the reduction being greatest in those radial directions corresponding to the principal axes of deflection and less for the radial directions corresponding to the diagonals inbetween.

* * * * *